US006139442A

United States Patent [19]

Wilson

[11] Patent Number: 6,139,442

[45] Date of Patent: Oct. 31, 2000

[54] GOLF SWING LEARNING AID

[76] Inventor: Robert Richard Wilson, 29 Cliff Avenue, Winston Hills, New South Wales, 2153, Australia

[21] Appl. No.: 09/260,229

[22] Filed: Mar. 3, 1999

[30] Foreign Application Priority Data

Mar. 4, 1998 [AU] Australia ..... PP2118

[51] Int. Cl.[7] ..... A63B 53/06

[52] U.S. Cl. ..... 473/220; 473/219; 473/221; 473/222; 473/257; 473/260; 473/267; 473/268; 273/186

[58] Field of Search ..... 473/219, 220, 473/221, 222, 257, 260, 199, 202, 226, 267, 268; 273/186

[56] References Cited

U.S. PATENT DOCUMENTS

| | | | |
|---|---|---|---|
| 2,787,470 | 4/1957 | Barrus . | |
| 3,191,939 | 6/1965 | Hooper . | |
| 3,649,028 | 3/1972 | Worrell | 273/186 A |
| 3,649,029 | 3/1972 | Worrell | 273/186 C |
| 3,753,564 | 8/1973 | Brandell | 273/186 A |
| 3,820,795 | 6/1974 | Taylor | 273/186 A |
| 4,137,566 | 1/1979 | Haas | 364/410 |
| 5,230,512 | 7/1993 | Tattershall | 273/186.3 |
| 5,288,080 | 2/1994 | Tice . | |
| 5,470,072 | 11/1995 | Cunningham | 273/186.3 |
| 5,692,964 | 12/1997 | Smith . | |
| 5,709,610 | 1/1998 | Ognjanovic | 473/223 |

*Primary Examiner*—Lee Young
*Assistant Examiner*—Paul D. Kim
*Attorney, Agent, or Firm*—Jones & Askew, LLP

[57] ABSTRACT

A device that provides feedback to a golfer on the characteristics of their swing of a golf club. The device can be mounted to or incorporated into the head of the golf club and includes a first light source and at least a second light source. The first and second light sources are aligned such that an imaginary line bisecting the first and second light sources passes through the sweet spot of the ball-striking face. When the club head is at the address position, the imaginary line lies in a horizontal plane and is further preferably at right angles to the ball-striking face in that plane. The first and second light sources are visible to the golfer when using the golf club at least at the time when the club head is striking the ball. The first light source has a first turn on/turn off cycle pattern and the second light source has a second turn on/turn off cycle pattern that is different to that of the first light source. The improvement of the club head results in two dashed streaks of light persisting in the golfer's vision. The relative position of the two streaks and of the dashes constituting the two streaks provides the golfer feedback on the direction of the swing, orientation of the club head, and club head speed relative to some pre-set value.

32 Claims, 5 Drawing Sheets

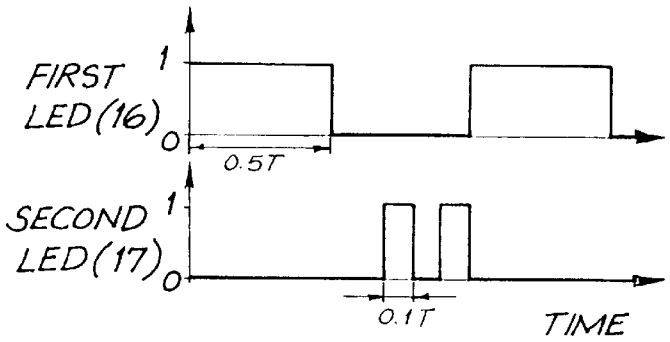
FIG. 5(a)
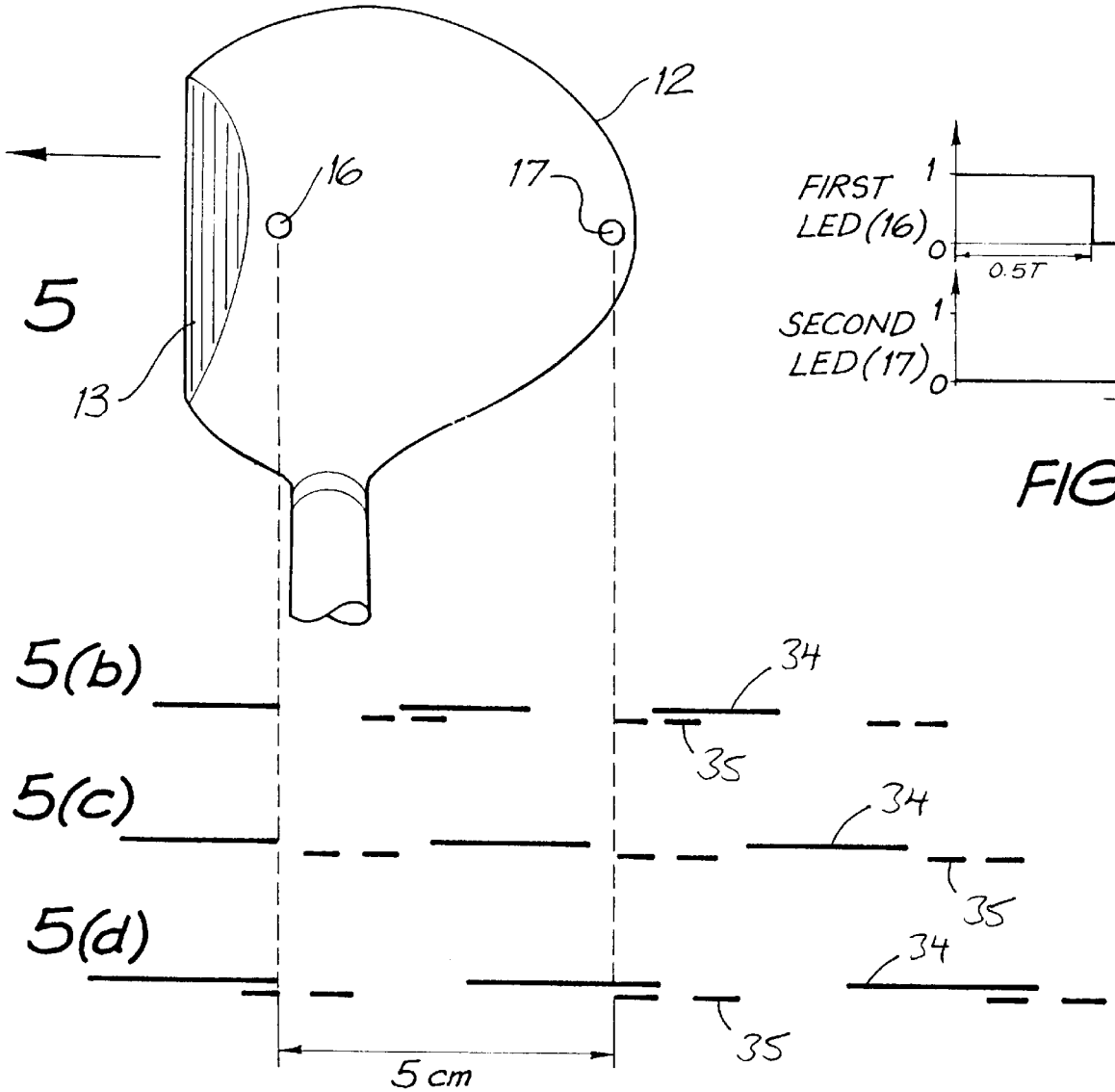
FIG. 5
FIG. 5(b)
FIG. 5(c)
FIG. 5(d)

GOLF SWING LEARNING AID

FIELD OF THE INVENTION

The present invention relates to a device for improving the swing of a golfer.

BACKGROUND TO THE INVENTION

Golf is a popular and well known sport. The sport while played at a professional level is also played by many golfers who are content to play the sport simply for the desire to improve their skills in striking the golf ball in a desired direction and for the enjoyment of successfully achieving this task and playing a satisfying round.

The swing of a golfer is fundamental to the sport. By use of the term "swing", it is to be understood as constituting the action taken by a golfer to strike the golf ball in a desired direction. The swing is necessarily used in all shots in golf, including those called drives, chips and putts.

It is well understood that the swing of a golfer can be improved by ensuring that the golfer concentrates on a number of factors before and during their swing. Some factors before the swing include taking an appropriate stance and gripping the club in the appropriate manner. During the swing, it is generally recognised that the golfer should focus on the ball during the back swing and the forward swing until at least the club head has struck the ball. Another factor is that the ball must preferably be struck with the sweet spot of the club head. A further factor is that the path of the swing just before and just after coming into contact with the ball lust preferably be at about 90° to the plane of the ball-striking face of the club head. Any deviation from this desired path, will often result in either a hook or slice shot.

The present invention provides a device that can be used by golfers to identify defects in their swing. Once the golfer has identified any problems, the golfer can then seek to correct their swing and observe the result. Of course, once a defect is identified, the option is available for the golfer to seek advice on swing correction from a skilled player or coach.

DISCLOSURE OF THE INVENTION

According to a first aspect, the present invention consists in a device for improving a golfer's swing of a golf club, the device being mountable to the golf club and including a first light source and at least a second light source, the first and at least second light source being visible to the golfer when using the golf club for at least a portion of the golfer's swing, the first light source having a first turn on/turn off cycle pattern and the second light source having a second turn on/turn off cycle pattern that is different to that of the first light source.

The device according to the present invention depends on the property of the human brain to visualise the path of a fast moving light source as a line of light in one's retained vision. Where the light source turns on and off, the resulting path in the retained vision is all interrupted line of light, with the pattern of interruptions dependent on the turn on/turn off pattern of the light source.

In one embodiment of the invention, the first light source and the at least second light source each comprise a light emitting diode or LED. Other light sources such as fibre optics call be readily envisaged. In a preferred embodiment, the first and second light source call comprise light emitting diodes of different colours. For example, the first light emitting diode can be red and the second light emitting diode a different colour, such as green.

In one embodiment, the first and at least second light sources call be mounted to or in the head of the golf club. In this embodiment, the light sources are preferably permanently mounted to or in an upper surface of the head of the club. The first light source is preferably mounted in the upper surface immediately adjacent the front ball-striking surface of the head. The first light source is also preferably located proximate the preferred ball-striking portion of the ball-striking surface or the area commonly known as the "sweet spot" of the club head.

The second light source is preferably positioned distal the ball-striking surface at a distance that is as large as practical from the first light source given the dimensions of the club head. Because of the desire for there to be a maximum distance between the first and second light sources, the light sources are particularly suitable for being mounted in or to the club head upper surface of a driving club and in particular in those clubs commonly known in golf as "woods". The distance between the light sources call lie in the range 3 to 7 cm, and call in a particular embodiment be about 5 cm. Where the light sources are mounted to the upper surface of the club head, the light sources call be mounted within depressions formed in the upper surface of the club. The depressions call be hemispherical, pyramidal or conical and call be used to provide protection for the light emitting diodes.

Where the shape of the club head is not suitable for providing a desired spacing between the first and at least second light source, such as a high numbered iron (eg. a five iron), a housing call be provided for the light sources that is removably or non-removably mountable to the club head. As when the light emitting diodes are mounted in the club head, the diodes in the housing call be mounted within depressions formed in the housing.

Where the light sources are mounted in the club head or in the housing, the first and at least second light sources are preferably aligned such that all imaginary line bisecting the first and second light sources passes through the sweet spot of the ball-striking face. In use, with the club head at the address position (ie. adjacent the ball or the location of all imaginary ball), the imaginary line lies in a horizontal plane and is preferably at right angles to the ball-striking face in that plane.

A power source for the light sources call comprise one or more batteries. While the one or more batteries can be mounted within battery cases provided within the head of the club, they will more preferably be mounted within the shaft of the golf club. In either case, suitable wiring can extend from the battery cases through appropriate circuitry to the light emitting diodes. Where the batteries are placed in the shaft, such wiring would typically extend within the shaft. The batteries call preferably be replaced when required by opening a hatch or access port in the shaft or head of the club. An activation switch for the light sources call also be provided on the club. In a preferred embodiment, the activation switch call comprise a double pole switch mounted to the end of the shaft distal the head.

In all alternative embodiment, the batteries can be mounted within a pack worn by the golfer when using the device. In the latter case, wiring would extend from the pack to the light sources. In one embodiment, wiring would extend from the pack to sockets provided in the shaft. If the light sources are mounted in the club head, wiring could extend from the sockets through the shaft to the light sources. If the light sources are mounted in a housing, wiring could extend from the sockets to the housing or could extend directly from the pack to the housing. An activation switch in this embodiment could be provided on the pack to allow control of power from the batteries in the pack to the light sources in the club head.

The device preferably includes appropriate electronic circuitry to control the respective first and second turn on/turn off cycle patterns of the first and second light sources. Such circuitry call be located within the club head, the club shaft or in the pack worn by the golfer. Such circuitry is substantially solid-state circuitry and is powered by the power source. The circuitry call also if desired allow the brightness of the light sources to be varied.

The respective first and second turn on/turn off cycle patterns can be pre-set at manufacture of the device or call be adjustable by the golfer, with the respective turn on/turn off patterns adjustable to suit the normal swing speed of the golfer using the device. The on/off cycle patterns of the first and/or second light sources call be periodic. In one embodiment, in each period of the on/off cycle of the first light source, the light source is on for half the period and off for half the period. In each period of the cycle of the second light source, the light source call turn on a for a short length of time before turning off for a length of time greater than the on-time. In a particularly preferred embodiment, the second light source call switch oil, then off, then on and then off again over a relatively short length of time before being off for a relatively long length of time.

In a particularly preferred embodiment, the second light source turns on when the first light source is off. In the embodiment, where the second light source switches on, then off, then on and then off in a relatively short period of time, the time that the second light source is on preferably occurs when the first light source is off.

In use, during movement of the club head, the first and second light sources are visible as respective lines of light in the golfer's retained vision. As the light sources are turning on and off with different cycle patterns, the respective lines of light are broken up into different dashed lines of light on the golfer's retained vision. Where the first light source is turning on and off at all equal rate and the club head is swung by the golfer such that it is moving at a substantially constant speed, the first light source generates a dashed line of light in the retained vision of the golfer wherein each dash of light is of about all equal length and also equal in length to the space between the dashes. Where the second light source is turning on twice in a short length of time and then off for a relatively long length of time and the club head is swung by the golfer, the second light source generates a dashed line of light comprised of groups of two spaced relatively short dashes of light, with each group separated by a long space.

In one embodiment of the invention, the device call be used in conjunction with a guiding means placed on the ground. The guiding means can be used with or without a ball. For example, a golfer call choose to practice indoors without striking the ball during their swing. The guiding means call be used to provide a guide to the golfer as to whether their swing is passing along a desired path to achieve a good swing. The guiding means call comprise a mat having one or more guiding devices visible to the golfer when the golfer is standing over the mat about to practice a swing. Each of the guiding devices call comprise a light source. One of the light sources on the mat call represent the aiming point for the club head and the other light sources call be aligned and define the intended target direction.

In a particularly preferred embodiment, where the light sources are mounted within the club head, it is preferred that the club be robust to an extent that it call be used to drive normal golf balls using an average golfer's swing. In this case, the distribution of the components of the device within the club is preferably such that the club has a weight and balance similar or the same as that of a similar club which does not incorporate the device. The result is a club having swing characteristics that match those of a similar club without the device. This is particularly advantageous as it allows the golfer to practice a real golf swing when using the device. It also means that the golfer is not forced to make any adjustments to their swing when they revert to using their standard clubs.

In the case where the golfer is practising using the device by striking a standard golf ball, it is preferred that the ball be placed on a fixed support, such as a fixed but flexible golf tee or marker. The presence of the fixed tee or marker allows the golfer to assess the position of the lines of light relative to the ball's set-up position on the tee or marker, even after the ball has been struck. Because the support is fixed in position,

BRIEF DESCRIPTION OF THE DRAWINGS

By way of example only, a preferred embodiment of the invention is now described with reference to the accompanying drawings, in which:

FIG. 5 is a plan view of a head of a wood having a housing having a first and second light source in its upper surface.

FIG. 5*a* provides an illustration of one timing sequence for the light sources and FIGS. 5*b* to 5*d* depict examples of the types of light traces generated in the retained vision of the golfer by the light sources on various swings of the golf club head;

PREFERRED MODE OF CARRYING OUT THE INVENTION

Figure 1:
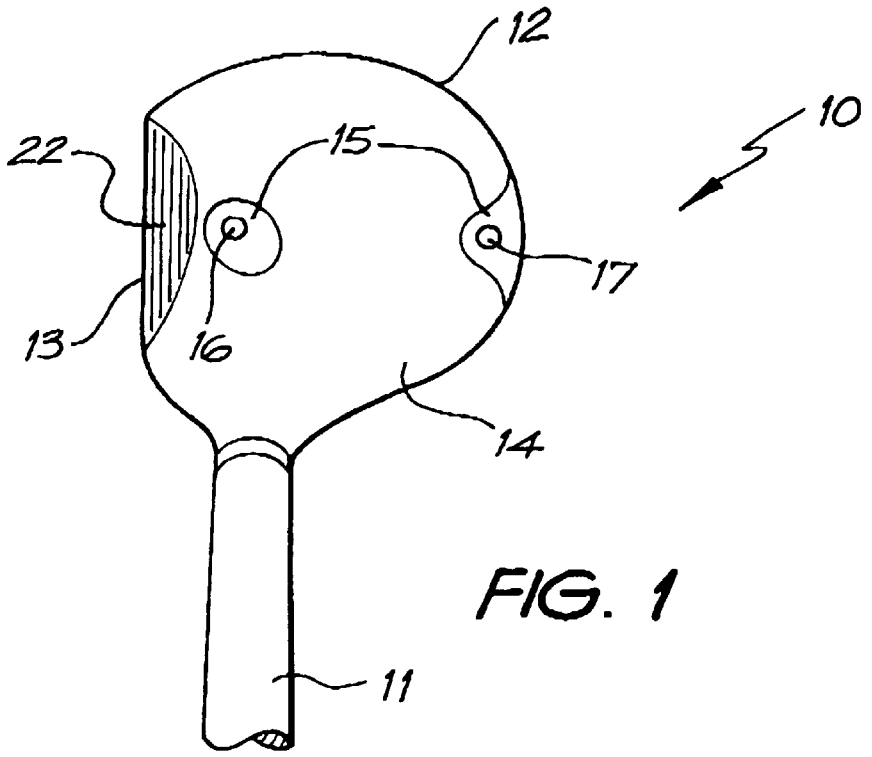
FIG. 1 is a plan view of a head of a golf club having a first and second light source embedded below its upper surface.
Figure 2:
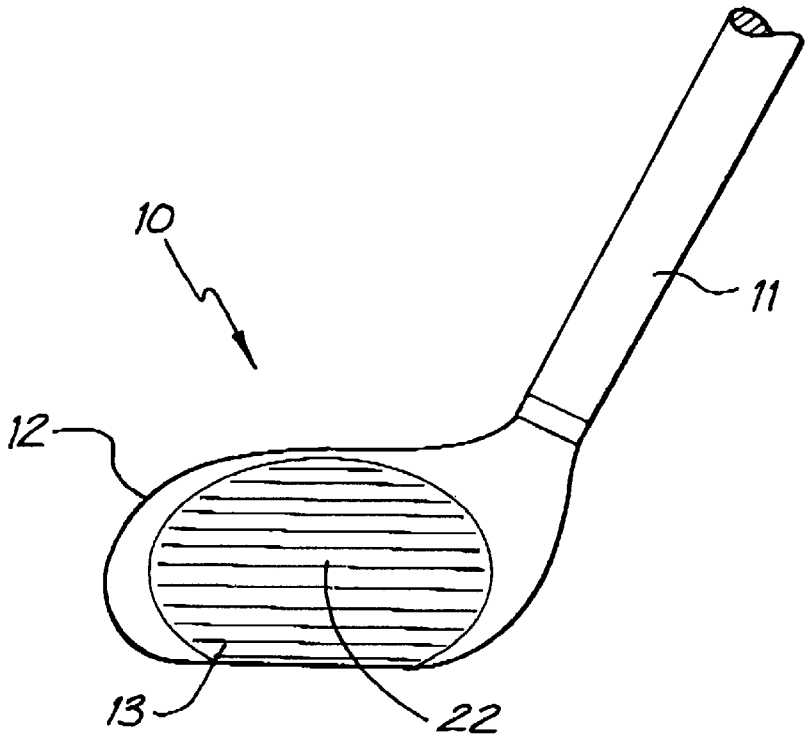
FIG. 2 is a side elevational view of the club head of FIG. 1.
Figure 7:
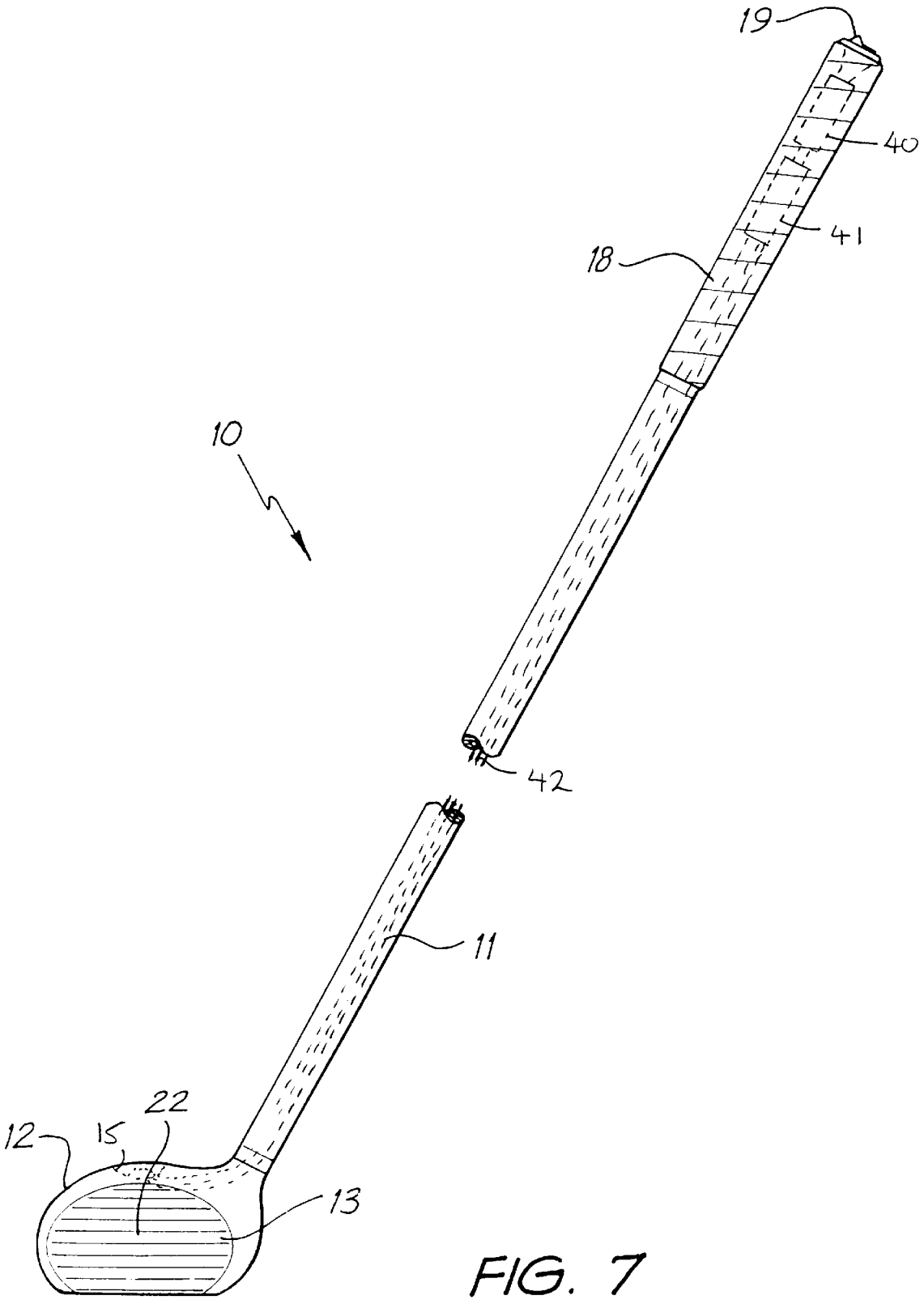
FIG. 7 is a side elevational view of a golf club having the head of FIGS. 1 and 2.

A golf club incorporating the features of the present invention is generally depicted as 10 in FIGS. 1, 2 and 7. The club 10 is of a the type commonly called a "wood" in golf and comprises a shaft 11 and a head 12. The head has a ball-striking face 13 and an upper face 14. The preferred impact point on the ball-striking face 13 or sweet spot is depicted as 22 in FIGS. 1,2 and 7. The club 10 is designed for use in striking real golf balls but can be used to practice swings without striking a ball. The swing characteristics of the club 10 are preferably substantially identical to a club of similar type and dimensions but which does not incorporate the features of the present invention.

Disposed in respective depressions 15 in the upper face 14 are a first light source 16 and a second light source 17. The first light source comprises a red light emitting diode (LED) and the second light source comprises a green light emitting diode (LED). While different coloured light emitting diodes are preferred, the invention call use same coloured light emitting diodes. While the different colours are preferred, the club 10 call still be used by a colour blind person as will be described below.

As is clear from FIG. 1, the first light source 16 is positioned adjacent the face 13 of the club head 12. The first and second light sources 16,17 are also respectively positioned such that an imaginary line bisecting the first and second light sources passes through the sweet spot 22 of the ball-striking face 13. In use, with the club head at the address position (ie. adjacent the ball or the location of an imaginary ball), the golfer should position the club head such that the imaginary line lies in a horizontal plane and is preferably at right angles to the ball-striking face in that plane. The alignment of the light sources 16,17 serves to minimise parallax errors when the golfer is using the device and attempting to determine if their swing was such that the sweet spot 22 would have struck the ball.

Batteries 40, 41 to power the light sources 16,17 are provided in the shaft 11 of the club 10. In the depicted embodiment, the batteries and associated circuitry for the device according to the present invention are provided within the shaft in the grip region 18 of the shaft 11. An on/off switch 19 for the device is also provided in the end of the shaft 11. The switch 19 allows the golfer to use the club 10 without relying on using the light sources 16,17 for swing guidance, if desired.

Wiring 42 between the batteries and the light sources 16,17 extends through the shaft 11 and into the head 12 before its connection to the light sources 16,17. In the depicted embodiment, the batteries can be accessed by removing the end plate incorporating the switch 19 on the shaft 11. While not depicted, it call be envisaged that the batteries and/or circuitry to control the operation of the light sources 16,17 could be positioned in a pack that is worn by the golfer during use of the club. In such a case, wiring would extend from the pack to the club 10.

Figure 3:
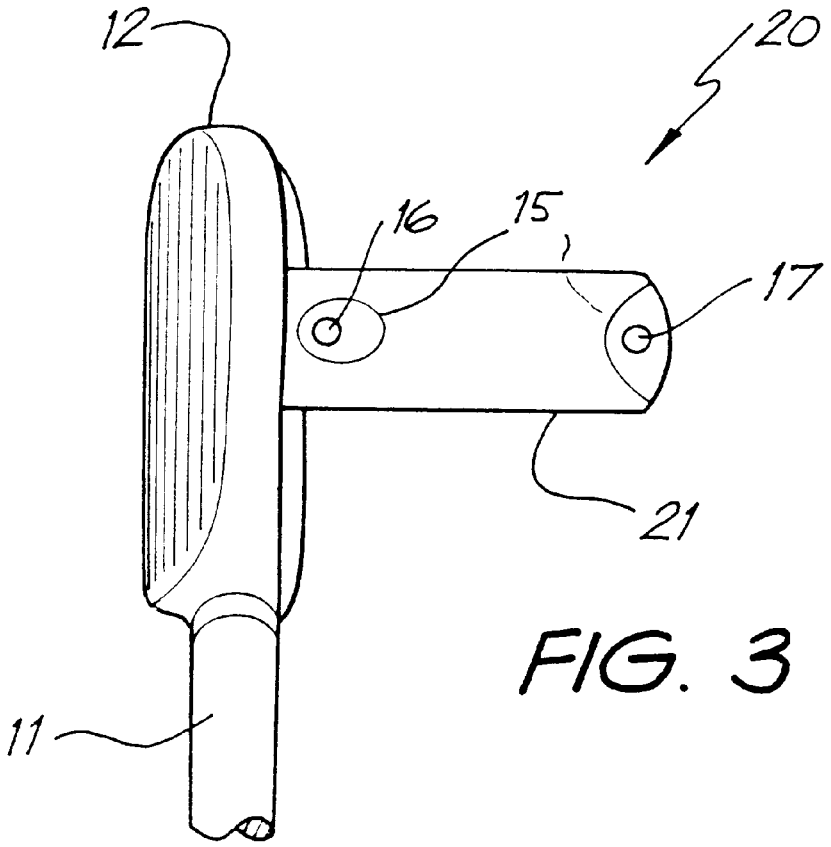
FIG. 3 is a plan view of a head of all iron club having a housing having a first and second light source in its upper surface.
Figure 4:
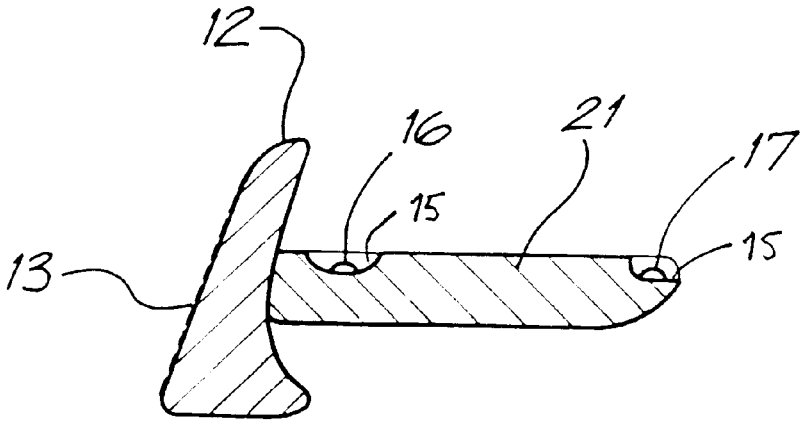
FIG. 4 is a cross sectional view of the iron head of FIG. 3.
Figure 6A:
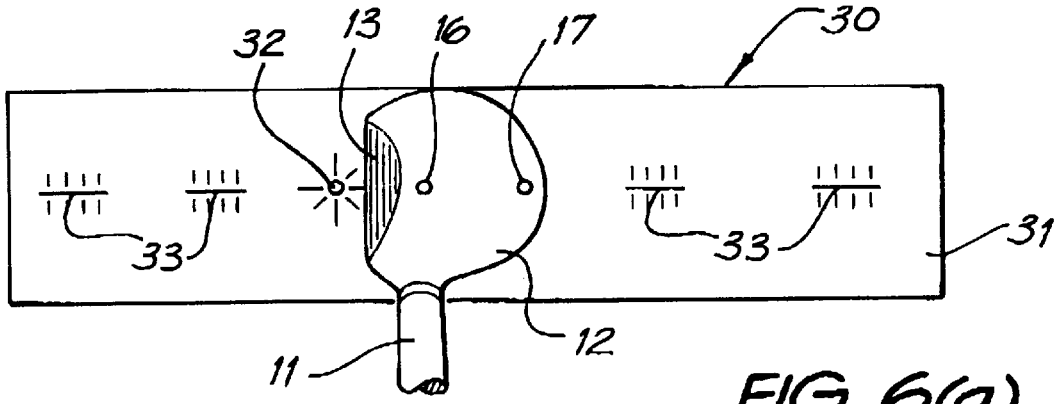
FIG. 6*a* is a plan view of the club head at rest on a guiding mat according to the present invention.
Figure 6B:
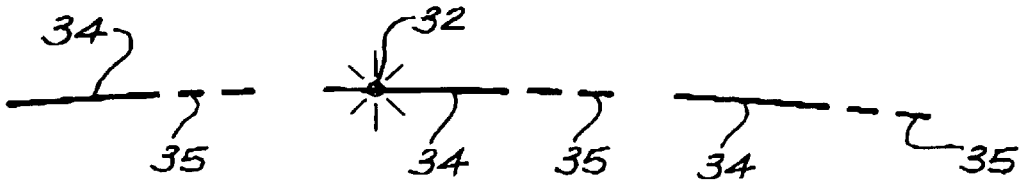
FIGS. 6*b* to 6*d* provide an illustration of further types of light traces that may be generated in the vision of the golfer by use of the device.
Figure 6C:
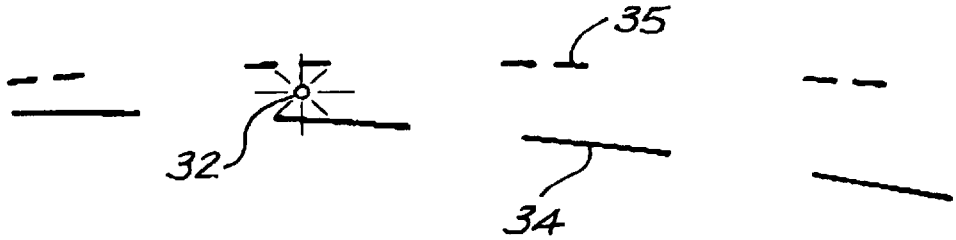
Figure 6D:
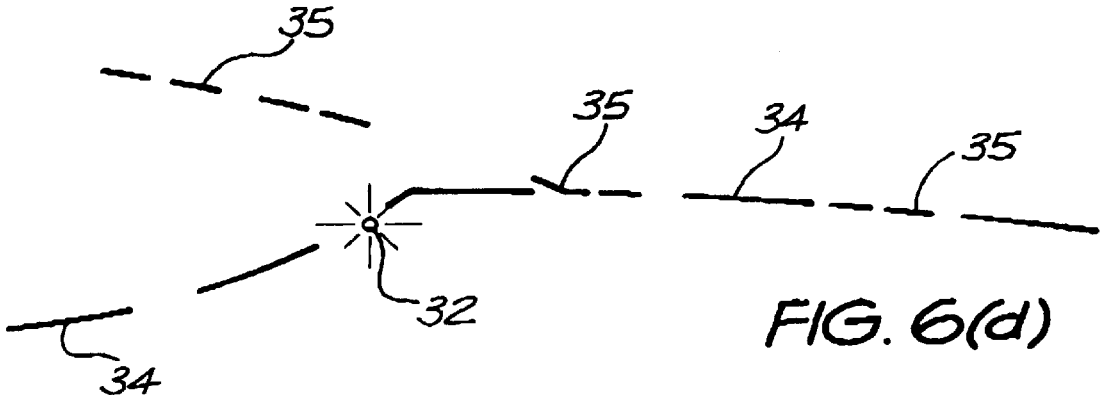

While FIGS. 1 and 2 depict the light sources 16,17 mounted in the head 12, for certain types of clubs this option is not possible. For example, in the case of a five iron 20, as is depicted in FIGS. 3 and 4, the upper surface area is typically quite small. In such cases, it is necessary to mount the light sources 16,17 in the upper surface of a housing 21. The housing 21 can be permanently mounted to the club 20 as is depicted in the drawings. It will be appreciated, however, that the housing 21 could be removably mounted to the club 20 if desired.

In the embodiment depicted in FIGS. 3 and 4, the batteries and circuitry are still positioned within the shaft. Wiring from the batteries and circuitry extends within the shaft and emerges from the shaft adjacent the housing 21 and then enters the housing 21. It will be readily envisaged that the wiring could extend along the outside of the shaft. When using the iron club 20, the batteries and circuitry could also be provided in a pack worn by the golfer as was described above with reference to the club 10.

As described, the golfer can practice using the club 10 or club 20 with or without striking a ball. If a ball is not being used, the golfer call choose to use a guiding device 30 such as is depicted in FIG. 6. It should, however, be realised that the golfer call choose to use a ball with the guiding device 30, if desired. The guiding device 30 comprises a mat 31 having a target indicator 32 (such as a light emitting diode). A further set of aligned indicator devices 33 (again, such as light emitting diodes) are also provided on the mat 31. The mat 31 incorporates a power source (eg. a battery) and appropriate circuitry for powering the light emitting diodes 32 and 33 in the mat 31. While the mat 31 has a plurality of light emitting diodes, it will be realised that the target indicator 32 and indicator devices 33 could simply comprise painted markings or the like on the mat 31.

The following description of the device is provided on the basis that the golfer does choose to use a ball when practising their swing using the device. The club incorporating the features of the present invention is best used in relatively low light conditions. Preferably, the ambient light is of a brightness that allows the golfer to readily see the light sources 16,17 but also allows the golfer to see the ball or marker. The light sources 16,17 are positioned such that they are visible to the golfer as the club 10 or club 20 strikes the ball if the golfer is looking at the ball at the time of impact. If the golfer does not see the light sources, this is all indication of a first defect with the golfer's swing, namely that the golfer is lifting his or her head before the club head has struck the ball.

As is depicted in FIG. 6(*b*), if the golfer holds his or her head in the correct position and swings the club head 12, the retained vision of the golfer sees two streaks of light, with one streak 34 being red from light source 16 and the other streak 35 being green from light source 17. A discussion of the dashed nature of the streaks 34,35 depicted in FIG. 6(*b*) is provided below.

In FIG. 6(*b*), the golfer has swung the club head such that the streaks 34,35 coincide with the position of target indicator 32 and further that the streaks 34,35 substantially overlap. This is indicative of a good swing as if the streaks overlap, it is indicative that the face 13 of the club has been moving essentially at right angles to the motion of the club head.

If the golfer sees streaks 34,35 in the positions depicted in FIGS. 6(*c*) and 6(*d*), it is indicative that the club head is not travelling on target and further that the ball-striking face 13 is not square to the direction of the swing. By noting the pattern of the streaks 34,35 and then actually following the flight of the ball, the golfer call correlate the pattern with the resulting ball flight and so use this information in attempting to correct swing defects. As the skill of the golfer increases, the patterns can also be used to help train a golfer to be able to hit deliberate hook or slice shots, which can be useful in many instances on the golf course.

The fact that the streaks 34,35 are different colours will allow most players to discriminate between the streaks. For those players that are colour blind, however, colour differences are not sufficient. Accordingly, the light sources 16,17 are connected to circuitry that results in the respective lights having different but periodic turn on/turn off cycle patterns.

The light timing sequence for lights 16,17 is provided in FIG. 5(*a*). As is depicted in FIG. 5(*a*), light source 16 is in each cycle adapted to be on for half the cycle and off for half the cycle. The result is the light 16 flashing on and off for equal lengths of time. In the case of the second light source 17, the light source remains off for seven-tenths of the cycle, then turns on for one-tenth of the cycle, then off again for one-tenth of the cycle, then on again for one-tenth of the cycle before turning off at the end of the cycle. The result is that the second light 17 flashes twice close together and then has a relatively long delay before again flashing twice. It will be noted from FIG. 5(*a*) that the second light source 17 is adapted to flash twice while the first light source 16 is off.

On club head 12 depicted in FIG. 5, the first and second light sources are separated by a distance of 5 cm. The combination of this gap, the timing sequence of the respective lights 16,17 and the frequency of the cycle of light source 16 results in the relative relationship of the components of the respective streaks to vary in position on variation in the speed of the swing of the club head 12. As is illustrated in the following table, for the club head arrangement depicted in FIG. 5 and where the frequency of oscillation of light source 16 is 750 Hz, the following relationship holds:

| Club Head Speed (km/h) | Club Head Speed (mm/s) | Light Source Cycle Wavelength (mm) | Red dash length (mm) | Green dash length (mm) | Streak pattern |
|---|---|---|---|---|---|
| 100 | 27800 | 37.0 | 18.5 | 3.7 | See FIG. 5(b) |
| 125 | 34700 | 46.3 | 23.1 | 4.6 | See FIG. 5(c) |
| 150 | 41700 | 55.6 | 27.8 | 5.5 | See FIG. 5(d) |

With increase in club head speed, the length of the dashes of light constituting the streaks 34,35 increases. This increase in length combined with the offset in position of the respective light sources 16,17 results in the relative positions of the dashes constituting the streaks varying as depicted in FIGS. 5(*b*)–(*d*). In particular, the position of the double dash constituting streak 35 moves across the gap between the larger red dashes as the swing speed is increased from 100 km/h through to 150 km/h. If the device is set up such that the double green dash of streak 35 is in the middle of the gap of streak 34 when the club is swung at a pre-set speed, in this case 125 km/h, the golfer is provided by observing the streak patterns with a ready means of determining their swing speed relative to the pre-set speed. Namely, the golfer is in a position to determine if their swing was faster or slower than the pre-set speed of the device.

By adjusting the frequency of the turn on/turn off cycle of the first and second light sources 16,17, it is possible to modify the particular swing speed at which the green dashes will appear approximately in the centre of the gaps between the red dashes. As such, it is relatively straight forward to provide a club that suits the normal swing speed of a particular golfer.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A device for improving a golfer's swing of a golf club, the device being mountable to the golf club and including a first light source and at least a second light source, the first and at least second light source being visible to the golfer when using the golf club for at least a portion of the golfer's swing, means for controlling the first light source to have a first turn on/turn off cycle pattern and means for controlling the second light source to have a second turn on/turn off cycle pattern that is different to that of the first light source.

2. The device of claim 1 wherein the first light source and the at least second light source are each a light emitting diode.

3. The device of claim 2 wherein the first and second light source are respectively light emitting diodes of different colours.

4. The device of claim 3 wherein the first light emitting diode is red and the second light emitting diode is a different colour.

5. The device of claim 1 wherein the first and at least second light sources are mounted in a head of the golf club.

6. The device of claim 5 wherein the first and at least second light source light sources are mounted in or to an upper surface of the head of the club.

7. The device of claim 6 wherein the first light source is mounted in the upper surface immediately adjacent the front ball-striking surface of the head.

8. The device of claim 7 wherein the first light source is located proximate the preferred ball-striking portion of the ball-striking surface or the sweet spot of that surface.

9. The device of claim 8 wherein the second light source is positioned distal the ball-striking surface at a distance that is as large as practical from the first light source given the dimensions of the club head.

10. The device of claim 9 wherein the first and at least second light sources are aligned such that an imaginary line bisecting the first and second light sources passes through the sweet spot of the ball-striking face.

11. The device of claim 10 wherein when the club head is at the address position, the imaginary line lies in a horizontal plane and is at right angles to the ball-striking face in that plane.

12. The device of claim 11 wherein the light sources are mounted within depressions formed in the upper surface of the club.

13. The device of claim 12 wherein the depressions are hemispherical, pyramidal or conical.

14. The device of claim 1 wherein the first and at least second light sources are mounted in a housing that is removably or non-removably mountable to the club head.

15. The device of claim 14 wherein the light sources are mounted within depressions formed in the housing.

16. The device of claim 15 wherein the first and at least second light sources are aligned such that an imaginary line bisecting the first and second light sources passes through the sweet spot of the ball-striking face.

17. The device of claim 16 wherein when the club head is at the address position, the imaginary line lies in a horizontal plane and is at right angles to the ball-striking face in that plane.

18. The device of claim 1 wherein a power source for the light sources can comprise one or more batteries.

19. The device of claim 18 wherein the one or more batteries are mounted within battery cases provided within the head of the club or the shaft of the club.

20. The device of claim 1 wherein the device includes appropriate electronic circuitry to control the respective first and second turn on/turn off cycle patterns of the first and second light sources.

21. The device of claim 20 wherein the circuitry is located within the club head or the club shaft.

22. The device of claim 1 wherein the respective first and second turn on/turn off cycle patterns can be pre-set at manufacture of the device.

23. The device of claim 1 wherein the respective first and second turn on/turn off cycle patterns are adjustable by the golfer, with the respective turn on/turn off cycle patterns adjustable to suit the normal swing speed of the golfer using the device.

24. The device of claim 1 wherein the turn on/turn off cycle patterns of the first and/or second light sources are periodic.

25. The device of claim 24 wherein in each period of the on/off cycle of the first light source, the light source is on for half the period and off for half the period.

26. The device of claim 25 wherein in each period of the second light source, the light source call turn on a for a short length of time before turning off for a length of time greater than the on-time.

27. The device of claim 26 wherein the second light source switches on, then off, then on and then off again over a relatively short length of time, before being off for a relatively long length of time.

28. The device of claim 27 wherein the second light source turns on when the first light source is off.

29. The device of claim 1 further including a guiding means that call be placed on the ground and used in conjunction with the device.

30. The device of claim 29 wherein the guiding means comprises a mat having one or more guiding devices visible to the golfer when the golfer is standing over the mat about to practice a swing.

31. The device of claim 30 wherein each of the guiding devices comprise a light source.

32. The device of claim 31 wherein one of the light sources on the mat represents the aiming point for the club head and the other light sources are aligned and define the intended target direction.

* * * * *